US005357641A

United States Patent [19]

Schubert

[11] Patent Number: 5,357,641

[45] Date of Patent: Oct. 25, 1994

[54] PATIENT POSITIONERS FOR USE ON OSCILLATING AIR SUPPORT SURFACES

[75] Inventor: Paul E. Schubert, Raleigh, N.C.

[73] Assignee: Kinetic Concepts, Inc., San Antonio, Tex.

[21] Appl. No.: 823,281

[22] Filed: Jan. 21, 1992

[51] Int. Cl.[5] ..... A61G 7/057; A61G 7/07; A61G 7/075

[52] U.S. Cl. ..... 5/453; 5/424; 5/485; 5/632

[58] Field of Search ..... 5/453, 607, 609, 621, 5/632, 630, 485, 424, 425, 624, 922, 914; 128/869–873

[56] References Cited

U.S. PATENT DOCUMENTS

| | | | |
|---|---|---|---|
| Re. 28,916 | 7/1976 | Rice | 5/628 |
| 3,339,544 | 9/1967 | Kravitz | 5/81.1 |
| 3,434,165 | 3/1969 | Keane | 5/609 |
| 3,485,240 | 12/1969 | Fountain | 5/624 |
| 3,783,863 | 1/1974 | Kliever | 5/607 |
| 3,924,282 | 12/1975 | Bond | 5/632 |
| 4,151,842 | 5/1979 | Miller | 5/922 |
| 4,286,344 | 1/1981 | Ikeda | 5/624 |
| 4,607,402 | 8/1986 | Pollard | 5/485 |
| 4,672,952 | 6/1987 | Vrzalik | 5/609 |
| 4,754,509 | 7/1988 | Pollard | 5/485 |
| 4,872,228 | 10/1989 | Bishop | 5/425 |
| 4,873,710 | 10/1989 | Lotman | 5/453 |
| 4,873,734 | 10/1989 | Pollard | 5/425 |
| 4,934,002 | 6/1990 | Watanabe | 5/453 |
| 5,003,654 | 4/1991 | Vrzalik | 5/453 |
| 5,103,511 | 4/1992 | Sequin | 5/609 |

OTHER PUBLICATIONS

"Roto Rest" (1991); Biodyne II (1991) and Biodyne (1987) Advertisements available from Kinetic Concepts P.O. Box 8588, San Antonio, Tex. 78208.

*Primary Examiner*—Alexander Grosz

[57] ABSTRACT

An overlay sheet and a related method for positioning a bedridden patient on an oscillating air support system for maximum safety and maximum therapeutic benefit. An overlay sheet which positions the patient is provided including the sheet, the supports which are located between the patient's arms and torso, and a retaining VELCRO strap. The patient is positioned between the supports and retained by the VELCRO straps, thus, ideally positioned and prevented from sliding side-to-side during oscillation of the air support system.

7 Claims, 5 Drawing Sheets

PATIENT POSITIONERS FOR USE ON OSCILLATING AIR SUPPORT SURFACES

CROSS-REFERENCE TO RELATED U.S. PATENT

This invention relates to patient support surfaces of the general type described in U.S. Pat. No. 5,003,654, dated Apr. 2, 1991, in the name of John H. Vrzalik, which has been assigned to Kinetic Concepts, Inc. The specification of that '654 patent is hereby incorporated by reference into this present application, as though set forth in its entirety.

BACKGROUND OF THE INVENTION

1. Field Of The Invention

The present invention relates to a method and apparatus for positioning a patient during oscillating therapy, particularly for use with patient supports having inflatable air bags or the like adapted for rotating the patient from side to side. More particularly, it relates to a covering or sheet having thoracic supports (positioned between the torso and arms of a patient) and means for constraining the patient between the supports, such as by a VELCRO strap which connects from one support to the other in a manner which maximizes the therapeutic benefits of such an oscillating air support.

2. Background References

Air supports utilizing inflatable cushions for supporting patients are old in the art. One air support of that general type is described and disclosed in Applicants said '654 patent. Other such supports are well known in the prior art.

Others have referenced patient positioning straps in connection with support surfaces disclosed for turning patients. For instance, the Fountain patent (U.S. Pat. No. 3,485,240) discloses inflatable straps to help keep the legs of a patient apart while turning the patient.

U.S. Pat. No. 3,783,863 dated Jan. 8, 1974 discloses a patient immobilizing apparatus comprising a patient supporting table unit on which a patient lies. The patient is covered by an imperforate sheet of film-like material which forms a seal between the patient's body and the table. The region between the table top, the patient and the sheet is evacuated so that differential pressure forces secure the patient on the table.

U.S. Pat. No. 3,339,544 dated Sep. 5, 1967 discloses a mattress which includes means for correcting pedal deformities in children, which is incorporated in the top surface of the mattress. That reference, more particularly, shows conical and tubular members which are inflated to help correct deformities in the legs of the patient. The disclosure also shows, in FIG. 3, a flexible foot constraint which may be snapped into position within a recess on the mattress.

U.S. Pat. No. 28,916 reissue date Jul. 27, 1976 discloses an inflatable aquatic rescue board providing particular advantage in rescuing persons who have sustained injuries while swimming or diving, and who frequently must be held rigid to prevent further injuries while being removed from the water. Prior to inflation, the rescue board is quite flexible, permitting it to be rolled into a compact bundle for storage. Then, upon activation of a self-contained compressed gas supply, the rescue board quickly becomes stiff and buoyant to form an ideal aquatic stretcher. The board comprises a planar structure having two impervious parallel broad faces constrained to a maximum separation by internal members extending there between. Transverse reinforcements provide additional rigidity and two longitudinally extending flat springs facilitate unrolling of the rescue board under water during rescue. Strategically placed straps are provided for securing an injured person to the board and handles are placed for maximum ease of removal from water and transportation to competent medical treatment.

U.S. Pat. No. 4,286,344 dated Sep. 1981 discloses a mattress including a pair of ridges made of elastomeric material and disposed respectively on both sides of an elastomeric layer which is laid on the top of a spring unit and covered with an outer covering, the ridges protruding from the elastomeric layer. Each ridge partially or fully extends in the longitudinal direction of the elastomeric layers. A user lying on the mattress is prevented from falling from the mattress by the ridges.

U.S. Pat. No. 4,607,402 dated Aug. 16, 1986 discloses a retainer sheet which includes an array of pockets in which cylindrically shaped foam members are removably inserted to define a retainer structure enclosing a sleeping area. The foam units can be removed for laundering and can be positioned in abutting relationship to form a self-locking configuration.

U.S. Pat. No. 4,754,509 dated Jul. 5, 1988 discloses a retainer sheet including an array of pockets in which cylindrically shaped form members are removably inserted to define a retainer structure enclosing a sleeping area. The foam units can be removed for laundering and can be positioned in abutting relationship to from a self-locking configuration.

U.S. Pat. No. 4,871,228 dated Oct. 10, 1989 discloses a bed guard for temporary use to reduce the risk of falling out of bed comprising of at least one elongated bolster operatively assembled on top of a conventional mattress and releasably held in operative position along one side of the bed by a conventional bedsheet covering the mattress and the bolster and tucked under the mattress. A plurality of bolsters may be used on each side of the bed for additional protection.

U.S. Pat. 4,873,710 dated Oct. 10, 1989 discloses a patient support including a support surface and structure positioned about the support surface for lifting selected portions of the patient's body from the support surface so as to permit the insertion of an x-ray cassette beneath the selected portion of the patient's body. The structure for lifting preferably includes a plurality of inflatable runners. Structure for placing the inflatable runners in fluid connection with fluid supply means is provided such that the runners can be inflated. The runners are spaced apart from one another and adapted when inflated to lift and adjacent portion of the patient so as to permit the insertion of an x-ray cassette between adjacent runners and beneath the patient.

U.S. Pat. No. 4,873,734 dated Oct. 17, 1989 discloses a bumper sheet including an array of pockets in which relatively soft yet form-retaining inserts (such as foam plastic cylinders or inflatable bladders) are removably fitted to define a bumper area enclosing a sleeping or rest area within the confines of a cribbed rails or the like.

U.S. Pat. No. 4,934,002 dated Jun. 19, 1990 discloses a mat assembly constructed so it may be tilted about a longitudinal axis by means of a pair of inflatable air bags. The mat assembly has an upper air cushion sheet provided upon the underside of the frame, and a pair of air bags disposed upon the underside of the lower air cushion sheet at right and left thereof as viewed in the longitudinal direction. By supplying air to a bag upon one side and by discharging air from the bag upon the other side, the mat assembly is titled.

SUMMARY OF THE INVENTION

The present invention represents an improved and novel apparatus over the prior art. It is characterized by a number of advantages which increase its utility over the prior art devices, including its flexibility of use, its ability to reduce the risks of sliding of the patient on a cover sheet prevention of the patient frand ease of accessibility to the patient for administrative purposes.

A primary object of this present invention is to provide a covering or sheet that can be used to advantage by the prevention of a sliding movement by the patient from side-to-side. As mentioned above, other devices are known which are directed to constraining a patient, but these devices suffer from several problems. It is, moreover, an object of the present invention to provide a constraining apparatus comprising a sheet, removable supports to be located on both sides of the torso and a VELCRO strap connected to each of the supports thereby providing means of retaining the patient between the supports to prevent sliding.

Another object of the present invention is to provide a constraining device for the legs of the patient in addition to the torso of the patient comprising a sheet, removable supports positioned between the torso and each arm of the patient, removable supports positioned on both sides of each leg, and a VELCRO strap connected to each set of supports to provide means for retaining the patient's torso and legs between each set of supports.

Another object of the present invention is to provide a constraining device for children comprising a sheet, removable supports to be located on each side of the torso, additional removable supports to be located on the outside of each arm, and a VELCRO strap connected to each set of supports to provide means for retaining the patient's torso and arms between each set of supports.

It is a further object of the present invention to provide inexpensive removable supports to be connected to the sheet to ease accessibility to the patient during administrative purposes. Another object of the present invention is to provide VELCRO straps which eliminates the need for fasteners and provides quick assemble/disassemble of the retaining device.

Another object of the present invention is to provide a retaining sheet which is readily adaptable and transferable to different beds.

These objects and advantages are accomplished in the present invention by providing a sheet with removable supports connected thereon. The supports are strategically connected to be located between the torso and the arms of the patient. Each support is capable of being removed to allow complete access to the patient. VELCRO straps are connected to each support providing a means for retaining the patient between the supports to prevent sliding movements.

Also provided is a constraining apparatus comprising a sheet with removable supports connected thereon, to be located on each side of the torso, and supports to be located on each side of each leg. VELCRO straps are connected to each set of supports providing a means for retaining the patients torso and legs to prevent sliding movements.

Also provided is a constraining apparatus for children comprising a sheet with removable supports connected thereon, to be strategically located on each side of the child's torso, and supports to be located on each side of each arm. VELCRO straps are connected to each set of supports providing a means for retaining the child's torso and arms to prevent sliding movements.

Also provided is a constraining apparatus for large persons comprising a sheet with removable supports connected there, to be strategically located on each side of the torso between the torso and each arm. VELCRO straps are connected to each support to provide a means for retaining the large person's torso to prevent sliding movements.

Many other features, objects and advantages of the invention will be clear to those skilled in the art from the foregoing and following more detailed descriptions, particularly when viewed in light of the prior art and in conjunction with the accompanying drawings and appended claims.

DETAILED DESCRIPTION OF PREFERRED EMBODIMENTS

Figure 1:
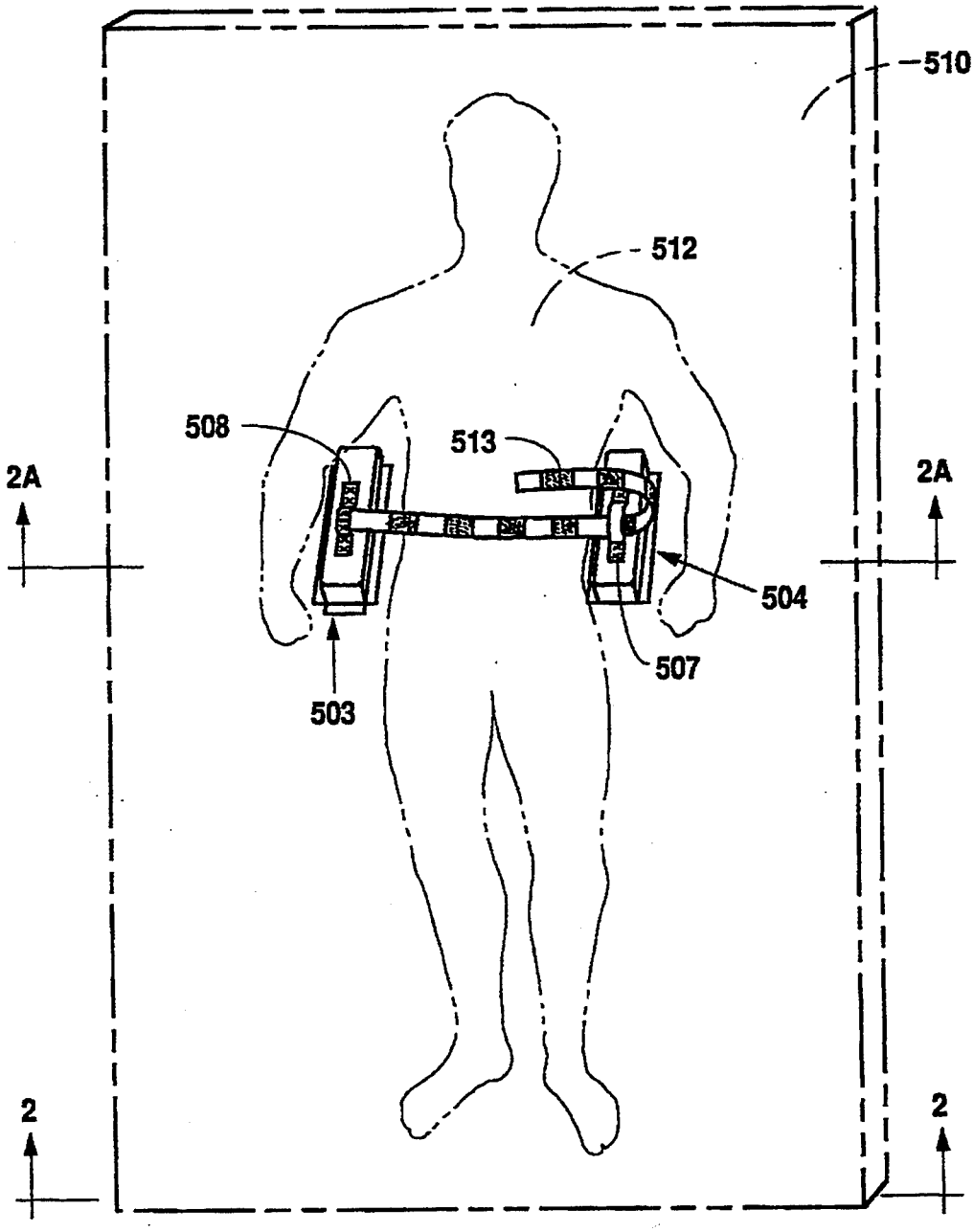
FIG. 1 is an overview of a first embodiment of the overlay sheet 510 of the present invention, as operatively employed with a patient 512 lying on overlay sheet 510.

Referring to FIG. 1, there is shown an overlay sheet 510 constructed according to the teachings of the present invention. Overlay sheet 510 comprises thoracic support pockets 503 and 504 and a VELCRO strap 513 which are used to retain a patient 512 in a preferred position. Aside from those elements 503, 504 and 513, the sheet 510 is a conventional low air loss bed overlay sheet (or "cover sheet") such as that currently employed by Kinetic Concepts, Inc. (San Antonio) on its commercially available Biodyne bed product.

Figure 2:
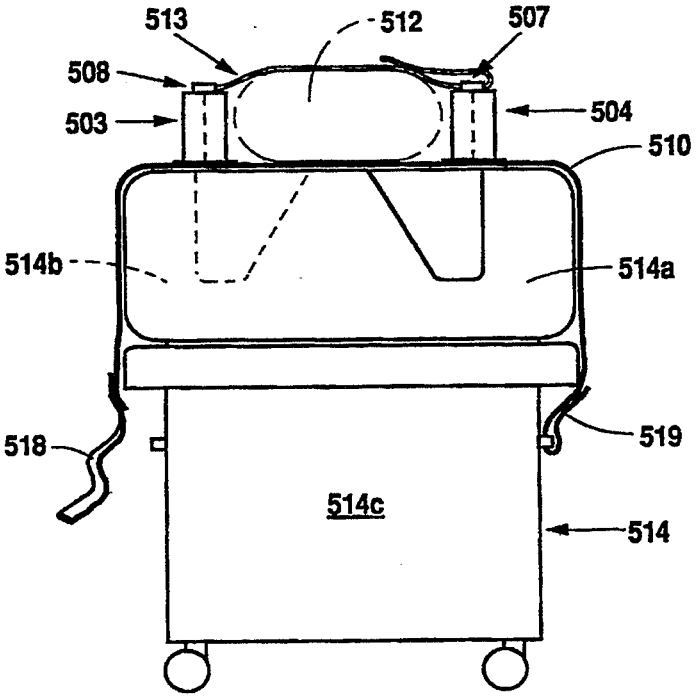
FIG. 2 is a partially-schematic end view of the first embodiment, depicting the sheet 510 on the top surface of an oscillating air support system 514.

As depicted in FIG. 2, sheet 510 is positioned on an oscillating air support system 514. The support system 514 (although only shown schematically in FIGS. 2 and 2A) preferably is that support system described in much more detail in said '654 patent, the description of which is incorporated herein by reference. Although that system is presently considered the most ideal, other types of static and oscillatory air supports, of course, could be substituted for that described in said '654 patent while still enjoying the benefit of many aspects of the present invention.

In operation, the cover sheet 510 fits over the alternately sloped air sacs 514*a* and 514*b* and is secured around its perimeter to the frame 514*c* of system 514 by anchor straps 518 and 519 in a conventional manner. Anchor straps 518 and 519 are spaced around and stitched to cover sheet 510 around its perimeter. As is conventional, anchor straps 518 and 519 are provided with Velcro connectors near their distal ends for easy connection to frame 514*c* in slots, loops and the like.

The support pockets 503 and 504 are stitched to sheet 510 in the preferred embodiment, although alternative methods of forming them will be evident to those of skill in the art in view of this disclosure. Pockets 503 and 504, preferably are substantially parallel and are spaced eighteen inches apart at their connections to sheet 510. Such configuration (as is more completely illustrated in FIG. 1) allows for ready positioning of the support pockets 503 and 504 between the torso and arms of the patient 512.

Figure 2A:
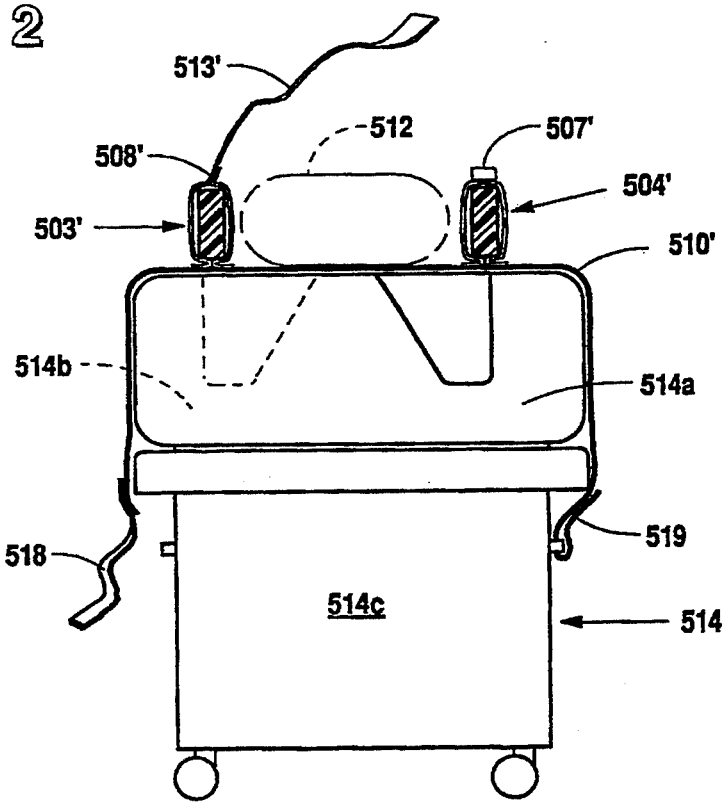
FIG. 2A is a partially-schematic cross-sectional view of a modification 510' of the first embodiment of the present invention, viewed from an angle similar to that of FIG. 2.
Figure 3:
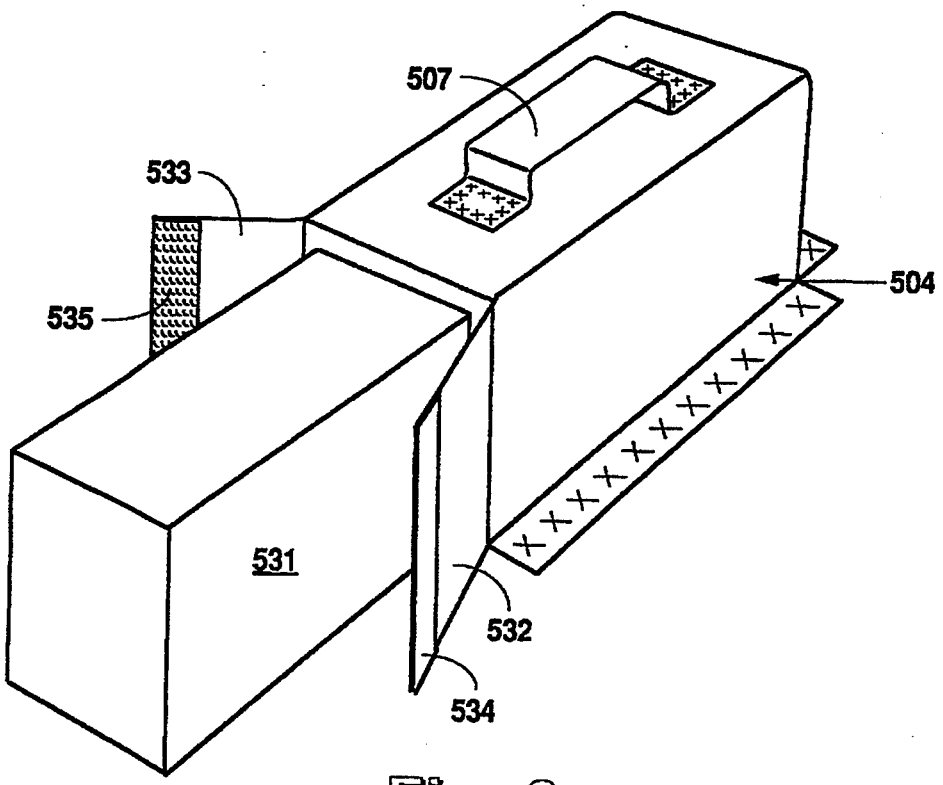
FIG. 3 is an exaggerated perspective view of the support pocket 504 of FIG. 1 showing the foam insert 531 positioned for operative insertion into pocket 504.

Referring to FIG. 2A, a second embodiment of the support pockets 503' and 504' are shown in a manner which tends to be more flexible than that of FIG. 2. Similar reference numerals are used to reference similar or related components of the embodiments shown in FIGS. 2 and 2A, although a prime (') designation is used where the similar components are distinguished in any respect. As is better viewed in FIGS. 3 and 4, pockets 503 and 504 are stitched to sheet 510 with a plurality of seams that preferably circumscribe its rectangular cross section. Pockets 503' and 504' on the other hand, are stitched along a single seam to sheet 510'. The latter connection tends to provide greater movement for the pockets 503' and 504' which may be desired in certain circumstances, whereas the former tends to bias the pockets 503 and 504 upright when used in conjunction with a patient. Many other alternative methods of connecting the pockets will be evident to those of skill in the art in view of this disclosure.

The Velcro straps 513, 527 and 537 in the various embodiments provide releasable means for releasably constraining a patient relative to the respective pockets 503, 504 and the like. Because each of the straps 513, 527 and 537 are essentially of the same construction except where otherwise specified herein, they can each be understood with reference to strap 513. The strap is preferably made of slightly elastic material with Velcro connectors sewn thereon, although the fabric itself could be Velcro compatible. One end of the VELCRO strap 513 is sewn or otherwise secured to the pocket 503 while its opposite (or distal) end is free to adjustably connect with the opposite pocket 504. The connection of its first, secure end to pocket 503 is preferably to a strip of material 508 which in turn is sewn to a surface (preferably the top surface) of support pocket 503. The distal end is provided with Velcro connecting material in the preferred embodiment, although ordinarily skilled individuals will recognize that certain other known connectors may also serve the same purposes. The strap 513 extends over the torso of the patient 512, interfaces with a strip of material 507 which is sewn to form a loop (like a belt loop) on the top surface of support pocket 507. After passing through that loop, the distal end can be wrapped back and connected with itself (as pictured in FIG. 2), thereby positioning the patient 512 in a defined position relative to the cover sheet 510.

Referring again to FIG. 3, the support pocket 504 is shown in more detail. The support pocket 504 is comprised of the pocket 504 adapted for receiving a foam support insert 531 to provide shape and support to help hold the patient in position. Pocket 504 also has a strip of material 507 which is sewn to the top surface of the pocket 504 to form a loop. That loop is for receiving the VELCRO strap 513 as shown in FIG. 1. The pocket 504 is made from durable material (preferably GoreTex fabric, as is sheet 510) and is formed of sufficient size to accept the seven inch by twelve inch foam support insert 531.

Further, the pocket 504 is sewn closed on all edges except the front edges, which open to accept the foam insert 531. The front face of the pocket 504 is comprised of two sides 532 and 533 which fasten to each other by means of a VELCRO connector. A strip of VELCRO hooks 535 is fastened to side 533 and a strip of VELCRO loops 534 are fastened to side 532. Connection of the VELCRO strips 534 and 535 retains the foam insert 531 in the pocket 504. The pocket 504 is connected to the sheet 510 by means of sewing the two side and rear end of the pocket 504 to the sheet 510. The inserts 531 are conventional foam rubber material thinly formed or cut substantially rectangular to fit between the body and arms of a patient in the preferred embodiment.

Figure 4:
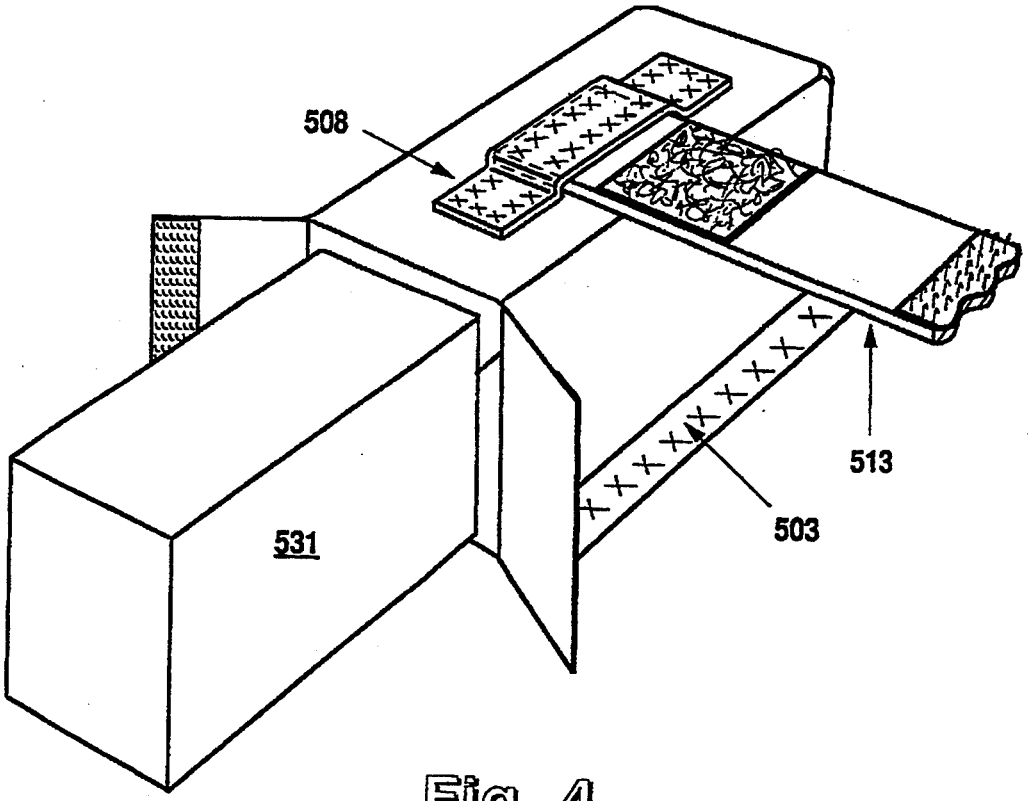
FIG. 4 is a cut-away perspective view of the support pocket 503 of FIG. 1 showing the distinctions between pocket 503 and pocket 504, which is shown in FIG. 3.

The support pocket 503, depicted in FIG. 1, is fabricated identically as support pocket 504 with the exception of the strip of material 508 sewn to the top surface of the pocket 503 (see FIG. 4). One end of the VELCRO strip 513 is depicted in FIG. I and 4 is sewn to the top surface of the strip 508. The VELCRO strip 513 is comprised of an elastic strip, approximately thirty-one inches long by two inch square VELCRO loops. The hooks and loops are sewn to the elastic strip in an alternating pattern with a two inch space between each square.

In an alternate embodiment used to retain larger patients, the support pockets 503 and 504 are nine inches by sixteen inches and are spaced two inches apart. All other features of the alternative embodiment are identical.

Figure 5:
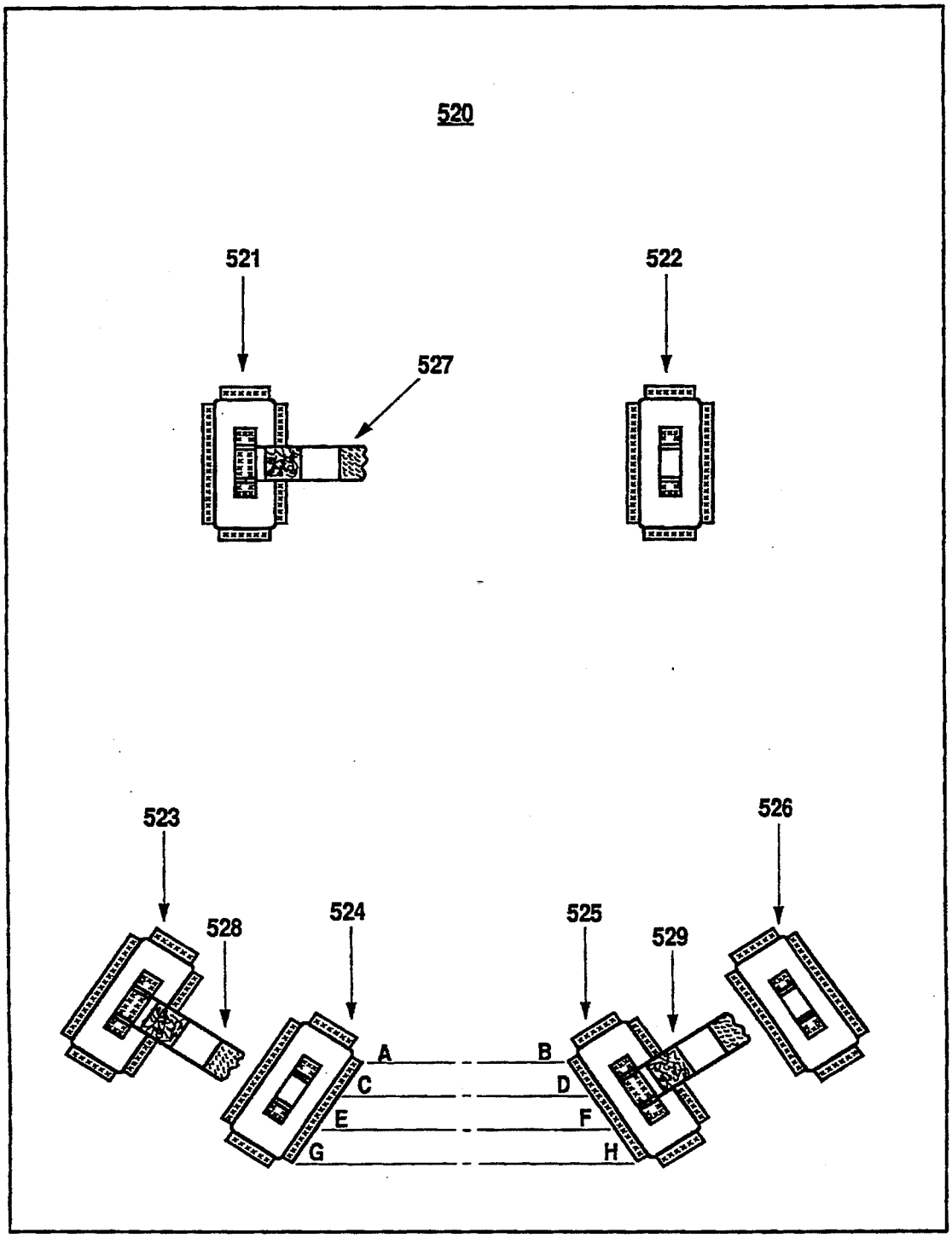
FIG. 5 is an alternative embodiment 520 of the sheet 510 including supports for the legs and torso of a patient.

Referring to FIG. 5, there is shown an alternative embodiment comprising an overlay sheet 520, support pockets 521 and 522 including a VELCRO strap 527 to retain the torso of a patient in a preferred position, and support pockets 523, 524, 525 and 526 including VELCRO straps 528 and 529 to retain the legs of a patient. The construction of the support pocket 522 is identical to support pocket 504 depicted in FIG. 3 and the support pocket 521 is identical to support pocket 503 (see FIG. 4). Support pockets 521 and 522 are to be spaced eighteen inches apart.

The support pockets 523 and 525, which are used to retain the legs of the patient in the alternative embodiment shown in FIG. 5, are identical in construction to support pockets 503, shown in FIG. 4, with the exception of the size of the support pockets which are four inches by twelve inches. The support pockets 524 and 526, also used to retain the legs of the patient of FIG. 5, are identical in construction to support pocket 4, shown in FIG. 3, with the exception of the size of pockets which are four inches by twelve inches.

The pockets 521 and 522 of FIG. 5 are spaced roughly eighteen inches apart and are sewn to the sheet 520 such that the torso of the patient is retained. The pockets 523 and 524, as well as the pockets 525 and 526, are spaced eight inches apart, in parallel to each other. Pockets 524 and 525 of FIG. 4 are sewn to the sheet 520 such that the spacing is: distance between Point A of pocket 524 and Point B of pocket 525 is three inches; distance between Point C of pocket 524 and Point D of pocket 525 is five inches; distance between Point E of pocket 524 and point F of pocket 525 is eight inches; and distance between point G of pocket 524 and point H of pocket 525 is eleven inches. These measurements are preferable but are not essential to most aspects of the invention.

The VELCRO straps 527, 528, and 529 of FIG. 5 are identical in construction with the VELCRO strap 513 of FIG. 1.

Figure 6:
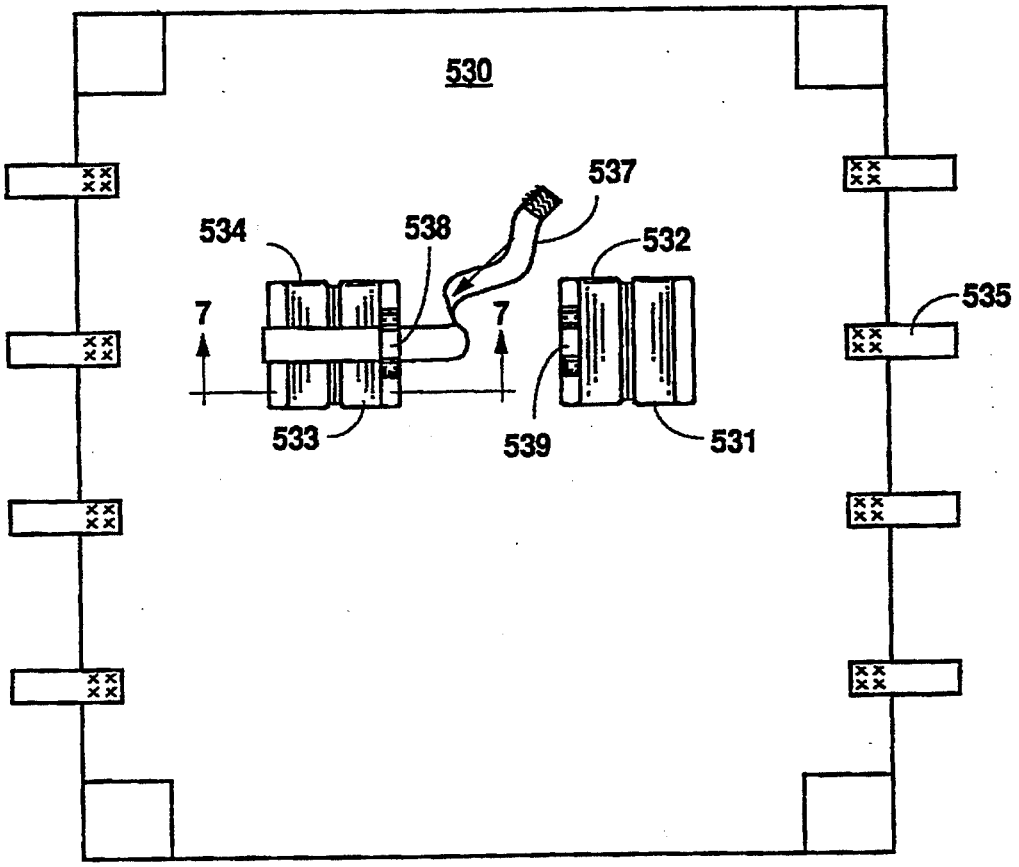
FIG. 6 is an alternative embodiment used for the constraint of children depicting support pockets for the arms and torso of the child.

Referring to FIG. 6, three is shown an alternative embodiment for the retention of child in a preferred position comprising a sheet 530, support pockets 531, 532, 533 and 534 for the retention of the child's torso and for each arm, and straps 535 used to secure the sheet 530 to the bed (see FIG. 2).

Support pockets 532 and 533 are sewn to sheet 530, six inches apart, such that the pockets 532 and 533 are positioned between the torso and arms of the child. Further, pockets 531 and 534 are positioned outside of pockets 532 and 533, respectively, such as to retain the arms in a preferred position. A VELCRO strap 537 is fastened to pocket 533 in a manner similar to FIG. 4 and interfaces with pocket 532 in a manner similar to FIG. 3 to retain the torso in a preferred position. Likewise, VELCRO straps are fastened to pockets 531 and 533 and interface with pockets 532 and 534 to retain the arms in a preferred position.

Figure 7:
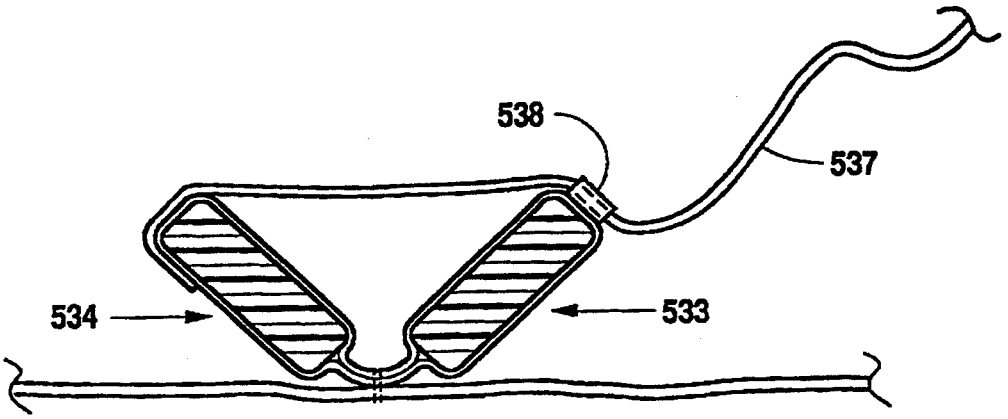
FIG. 7 is a cross-sectional view of the support pockets of the alternative embodiment used for the constraint of children taken along lines 7—7 in FIG. 6.

Support pockets 531 and 533 are similar in construction to the pockets shown in FIG. 2A, except for the specific manner of connecting a single Velcro strap 537 through two loops 538 and 539 before securing its free end to a Velcro connector on the outside surface of pocket 531. As an alternative, strap 537 is substituted with a plurality of shorter straps with separate connectors. Likewise, support pockets 532 and 534 are similar in construction. The configuration of pockets 533 and 534 are shown in FIG. 7. Similar to the construction of pocket 504 in FIG. 3, all edges of pockets 533 and 534 are sewn closed except for the front surface shown in FIG. 7. The front surface opens into two sides to allow foam supports to be inserted into the pockets 533 and 534. Each front surface has a VELCRO connector, one side having VELCRO hooks, the other side has VELCRO loops.

Although the present invention has been described in terms of the foregoing preferred embodiments, this description has been provided by way of explanation only and is not to be construed as a limitation of the invention, the scope of which is limited only by the following claims.

I claim:

1. An apparatus for positioning a person situated on an oscillating air support system for maximizing the therapeutic benefits of the oscillation provided by such system and preventing the patient from sliding side-to-side, comprising:

a flexible overlay sheet to be placed on a top surface of an oscillating air support system;

said sheet comprising a first support pocket and a second support pocket, each said pocket being located on the top surface of said sheet;

a hook and loop type connector, said hook and loop type connector being secured to said sheet; and each said support pocket being closed on all edges except a front edge which is used to accept supports.

2. The apparatus of claim 1, wherein:

said connector has a scheme of an alternating pattern of hooks and loops.

3. The apparatus of claim 1, wherein:

each said pocket is connected closed on all edges except the front edge thereof;

each said pocket has opposed flaps formed integral therewith at the front edge thereof, and each of the opposed flaps of each said pocket has hook and loop type connective devices formed integrally therewith for releasably securing the opposed flaps together to releasably close the front edge of each said pocket.

4. The apparatus of claim 3, further comprising supports inserted in each said pocket.

5. An apparatus for positioning a person situated on an oscillating air support system for maximizing the therapeutic benefits of such system and preventing the patient from sliding side-to-side, comprising:

an overlay sheet to be placed on a top surface of an oscillating air support system;

said sheet comprising support pockets strategically connected on a top surface of said sheet such as to position each said pocket between a torso of person and each of said person's arms;

said sheet further comprising support pockets strategically connected on said top surface of said sheet such as to position each said pocket on each side of each leg of said person;

said sheet further comprising a hook and loop type connector to constrain the said torso and each of said legs of said person;

said sheet further comprising a hook and loop type connector to constrain the said torso and each of said legs of said person;

said support pockets being closed on all edges except a front edge which is used to accept supports; and said hook and loop type connectors are connected to said sheet positioned such as to constrain said person about said torso and each of said legs.

6. An apparatus for positioning a patient situated on an oscillating air support system for maximizing the therapeutic benefits of such system and preventing the patient from sliding side-to-side, comprising:

an overlay sheet to be placed on a top surface of an oscillating air support system;

said sheet comprising support pockets strategically connected on a top surface of said sheet such as to position each said pocket between a torso of a patient and each of said patient's arms;

said sheet further comprising support pockets strategically connected on said top surface of said sheet such that said pocket is positioned outside of each arm of said patient;

said sheet further comprising a hook and loop type connector to constrain the said torso and each of said arms of said patient;

said sheet further comprises hook and loop type connectors connected on said top surface of said sheet near outside edges of sufficient quantity to connect the said sheet to said air support system; and said pockets being closed on all edges except a front edge which is used to accept supports.

7. An oscillating air support system for supporting a patient, comprising:

a frame;

first and second sets of separately inflatable air bags for maintaining low interface pressures between the surface of the air bags and a patient supported on the top surface thereof, the air bags having varying shaped cutouts formed near one end of the top surface thereof, the air bags having varying shaped cutouts formed near one end of the top surface thereof the air bags of said first set of air bags being mounted transversely to said frame means with the cutout closer to a first side of said frame means for receiving one side of the patient when the patient is rolled toward the first side of said frame means, and the air bags of said second set of air bags being mounted transversely to said frame means with the cutout closer to a second side of said frame means for receiving the other side of the patient when the patient is rolled toward the second side of said frame means;

means for selecting abase line pressure in the air bags of said first and second sets of air bags;

means for selecting first and second target pressures to which the air bags of each of said first and second sets of air bags are to be inflated;

means for sensing the air pressure in the air bags of said first and second sets of air bags and comparing the air pressure in the air bags to the target pressure selected for each of said sets of air bags and, then, alternately inflating the air bags of said first set of air bags to the selected first target pressure selected for said first set of air bags to roll the patient toward the first side of said frame means when said first set of air bags is inflated and inflating the air bags of said second set of air bags to the second target pressure selected for said second set of air bags when the air pressure in said second set of air bags is lower than the second side of said frame means, thereby therapeutically inhibiting the information and permitting the healing of bed sores and inhibiting the development of pulmonary congestion; and a cover sheet positioned over said air bags, said sheet having flexible thoracic support formed integral therewith for maximizing the therapeutic effect of the system.

* * * * *